US009297343B2

(12) United States Patent
Crossley et al.

(10) Patent No.: US 9,297,343 B2
(45) Date of Patent: Mar. 29, 2016

(54) NEEDLE FOR NEEDLE VALVE

(75) Inventors: Stephen O. Crossley, High Wycombe (GB); Andrew J. Limmer, Suffolk (GB); Mervyn J. Hackett, Suffolk (GB)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 829 days.

(21) Appl. No.: 13/522,769

(22) PCT Filed: Jan. 5, 2011

(86) PCT No.: PCT/EP2011/050104

§ 371 (c)(1), (2), (4) Date: Jul. 18, 2012

(87) PCT Pub. No.: WO2011/095370

PCT Pub. Date: Aug. 11, 2011

(65) Prior Publication Data

US 2012/0318893 A1 Dec. 20, 2012

(30) Foreign Application Priority Data

Feb. 4, 2010 (EP) ..... 10152677

(51) Int. Cl.

| | |
|---|---|
| ***F02M 51/06*** | (2006.01) |
| ***F02M 61/04*** | (2006.01) |
| ***F02M 61/12*** | (2006.01) |
| *F02M 47/02* | (2006.01) |
| *F02M 61/16* | (2006.01) |
| *F02M 61/18* | (2006.01) |

(52) U.S. Cl.

CPC ..... *F02M 51/0675* (2013.01); *F02M 51/0678* (2013.01); *F02M 61/042* (2013.01); *F02M 61/12* (2013.01); *F02M 47/027* (2013.01); *F02M 61/166* (2013.01); *F02M 61/1893* (2013.01); *F02M 2200/27* (2013.01); *F02M 2200/9007* (2013.01); *Y10T 29/49405* (2015.01)

(58) Field of Classification Search

CPC ..... F02M 51/0657; F02M 51/0675; F02M 51/0678; F02M 51/0682; F02M 61/12; F02M 61/042; F02M 61/166; F02M 61/1893; F02M 47/027; F02M 2200/27; F02M 2200/9007; Y10T 29/49405

USPC ..... 239/533.11, 533.2

See application file for complete search history.

(56) References Cited

U.S. PATENT DOCUMENTS 6,378,503 B1 * 4/2002 Lambert ..... 123/468
6,508,418 B1 * 1/2003 Fochtman et al. ..... 239/585.4

(Continued)

FOREIGN PATENT DOCUMENTS

WO 96/00348 1/1996
WO 2010/018024 2/2010

OTHER PUBLICATIONS

International Search Report dated Mar. 10, 2011.

*Primary Examiner* — Arthur O Hall
*Assistant Examiner* — Juan C Barrera
(74) *Attorney, Agent, or Firm* — Thomas N. Twomey

(57) ABSTRACT

A needle for use in a needle valve, such as the needle valve of a fuel injector, comprises a tip section (2), a first guide section (1*a*) and a second guide section (3). The tip section (2*a*) has a needle tip. The first guide section (1*a*) is remote from the needle tip. The second guide section comprises a tube, wherein the first guide section (1*a*) and the tip section (2*a*) are comprised in an integrated inner needle component (7) extending through the tube (3). A method of manufacturing such a needle is also described.

9 Claims, 3 Drawing Sheets

(56) References Cited

U.S. PATENT DOCUMENTS 6,598,809 B1 * 7/2003 Reiter et al. ..... 239/408
6,945,475 B2 * 9/2005 Lawrence et al. ..... 239/533.2
2004/0055562 A1 * 3/2004 Stewart et al. ..... 123/299
2005/0072865 A1 4/2005 Goto et al.
2008/0135020 A1 * 6/2008 Hornby ..... 123/478

* cited by examiner

NEEDLE FOR NEEDLE VALVE

TECHNICAL FIELD

The invention relates to a needle for a needle valve. In aspects, the invention relates to needle valves suitable for use in an injector system, particularly for a common rail fuel injector system.

BACKGROUND TO THE INVENTION

Needle valves are used in a variety of applications where dosing of fluid is required. A needle-shaped component is able to move within a valve body, with the needle tip adapted to rest on a seat at a nozzle tip of the valve body. Nozzle apertures are provided at the nozzle tip. The nozzle apertures are blocked when the needle tip rests on the seat. When the needle is forced away from the seat—for example, by hydraulic pressure within the valve—then fluid flow may take place. The needle will restrict flow unless the needle tip is moved some distance away from the seat, so this design of valve is suitable for precise dosing of fluid. A context in which such valves are regularly used is that of a fuel injector, such as the fuel injector of a common rail fuel injector system.

A needle valve for a fuel injector needs to meet a number of performance criteria: it needs to withstand a range of operating pressures, it needs sufficient structural strength and good resistance to wear to allow it to operate reliably over a good operating life, and it should be easy and cheap to manufacture and use. It is desirable to provide a needle valve that will perform better than conventional needle valves in respect of these performance criteria, particularly in respect of a fuel injector for use in a common rail fuel injector system for a diesel engine.

Developments on conventional needle valves are taught, for example, by US2009/0179166, DE 19503224 and WO 2004/106726. These all teach new designs of needle valves for use in gasoline injectors for specific technical purposes. US 2008/018101, published after the priority date of the present application, describes a number of multi-part needle designs for use in needle valves.

SUMMARY OF THE INVENTION

According to the present invention, there is provided a needle for use in a needle valve, the needle comprising: a tip section having a needle tip; a first guide section remote from the needle tip; and a second guide section comprising a tube, wherein the first guide section and the tip section are comprised in an integrated inner needle component extending through the tube.

This arrangement allows for a needle to be produced which is functionally effective but is also much lighter than a conventional valve needle, as the second guide section in the form of a tube will, with the right materials choice, be rigid and have good structural strength, while also being sufficiently light that the overall weight of the needle (and hence of the needle valve) may be substantially reduced.

Forming the first guide section and the tip section as sections of an integrated inner needle component is advantageous where greater structural strength is required but it is desirable to reduce the needle weight as compared to a conventional valve needle.

Advantageously, the tube is a metal tube. This provides effective structural strength and performance at the high temperatures present in a diesel fuel injector, and the manufacture of this component is straightforward and inexpensive.

Preferably the second guide section is retained over the tip section by a first interference fit, and advantageously the second guide section is retained over the first guide section by a second interference fit. This allows for easy and effective assembly of the needle component. In this arrangement, it is preferable if the first interference fit is tighter than the second interference fit.

An end of the tube associated with the first guide section may be formed as a spring seat for a biasing spring of a needle valve. This simplifies the manufacture of individual components and avoids the introduction of a recess.

The tube preferably has a plurality of apertures between connections to the needle tip section and the first guide section to allow fluid flow within the tube section. This is desirable to balance pressure in the needle valve, and will not have an effect on flow if the apertures are holes of sufficient size (for example 1.5 mm in diameter or greater). It may be desired to affect flow properties by establishing a pressure gradient within the needle valve, in which case smaller apertures may be used. In one arrangement, at least the apertures in the vicinity of the connection to the needle tip section are holes or slots sized to prevent substantially spherical particles of 0.15 mm diameter passing therethrough. This is effective to prevent debris reaching the nozzle apertures of a needle valve in which the needle is used.

In some arrangements, one or both of the tip section and first guide section is recessed to form a seat for the second guide section when the relevant section is engaged with the second guide section. This defines the connection regions between components effectively, and ensures accurate component alignment.

In one aspect, the invention provides a needle valve containing a needle as described above.

In another aspect, the invention provides a fuel injector containing such a needle valve.

In a further aspect, the invention provides a method of manufacturing a needle for a needle valve, comprising: forming an integrated component comprising a needle tip section and a first guide section for the needle; forming a tube to form a second guide section; and fixing the second guide section both to the needle tip section and to the first guide section.

Advantageously, the tube is a metal tube and forming the tube comprises swaging the metal tube.

Preferably, fixing the second guide section to the needle tip section and the first guide section comprises press fitting the second guide section both on to the needle tip section to form a first interference fit and on to the first guide section to form a second interference fit.

In this way, a needle of the type described above can be formed cheaply and efficiently using a novel combination of conventional machining and assembly processes.

BRIEF DESCRIPTION OF THE DRAWINGS

The invention will now be described, by way of example only, by reference to the following drawings in which.

DETAILED DESCRIPTION OF PREFERRED EMBODIMENTS

The needle and needle valve to be described below are suitable for use in an injector system, and in particular to a common rail fuel injector system. An existing common rail fuel injector system in which the needle and needle valve to be described may be used will now be discussed with reference to FIG. 1. This system is particularly suitable where diesel is the fuel used.

Benefits of common rail fuel injectors include minimal engine warm-up time, lower engine noise and lower emissions, as compared to other known systems. Typically, a common rail fuel system includes a common pressure accumulator, called the "rail", which is mounted along the engine block and fed by a high pressure pump. The pressure level of the rail is electronically regulated by a combination of metering on the supply pump and fuel discharge by a high-pressure regulator (when fitted). The pressure accumulator operates independently of engine speed or load, so that high injection pressure can be produced at low speeds if required. A series of injectors are connected to the rail, and each is opened and closed, such as by means of a solenoid valve or piezoelectric actuator, as directed by the engine control unit (ECU), which opens each injector electronically.

Figure 1:
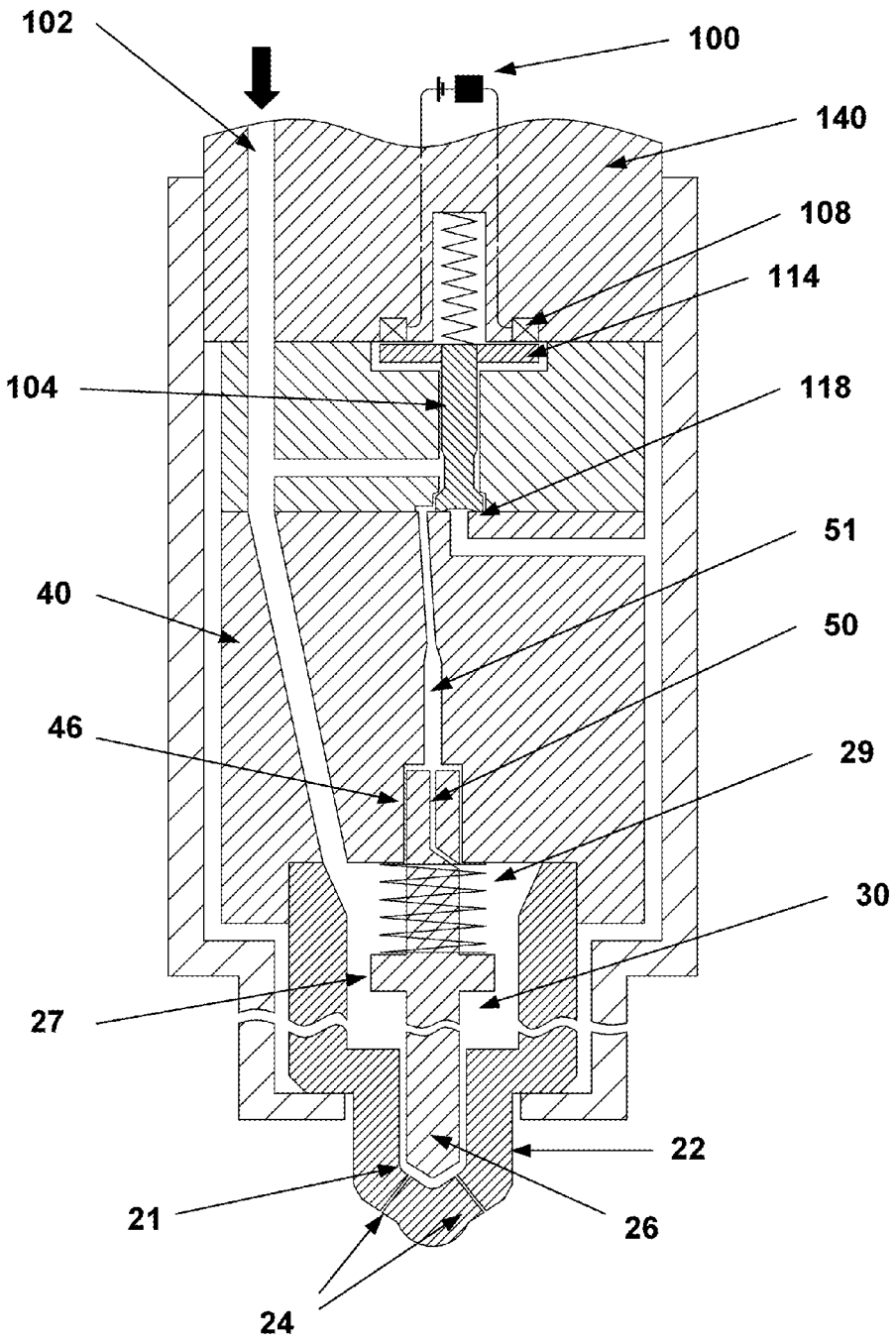
PRIOR ART Figure 1
FIG. 1 shows a prior art fuel injector system using a needle valve.

One form of conventional common rail fuel injector is shown by way of example in FIG. 1. It comprises a nozzle needle (26) slidable within a bore formed in a nozzle body (22) and engageable with a seating (21) at the free end of the bore to control delivery of fuel from the bore to a combustion chamber via one or more outlets (24) adjacent the free end. The bore includes a region towards the nozzle end of a diameter similar to the diameter of the needle (26) so that the bore acts as guide for the sliding movement of the needle. The bore also includes a region of enlarged diameter defining a gallery (30) for receiving fuel under pressure from a fuel supply passage (102).

The nozzle body (22) abuts a piston housing (40) that includes a bore (46) for receiving and guiding a projection that cooperates with, or extends from, the nozzle needle (26). A piston spring (29) acts upon a spring abutment surface formed by an extended diameter region (27) to urge the needle (26) towards the seating (21).

In the described example, the fuel supply passage (102) extends through a main body (140) of the injector and the piston housing (40) for conveying pressurised fuel to the fuel gallery (30) in the bore of the nozzle body (22). The fuel gallery (30) also communicates, continuously, with a restricted outlet passage (50), that allows fuel to be in communication with the supply passage (102) when the pin (104) is in the de-energised state. In the energised state of the pin (104), fuel is allowed to return to a relatively low pressure fuel reservoir. The outlet fuel passage (50) is generally shaped to restrict the rate at which fuel can flow from the fuel gallery (30).

Control of the fuel pressure within the injector is achieved using an electromagnetic actuator (100) that acts by way of a coil winding (108) which pulls an armature (114) against the force of a spring (106) to lift a pin (104) off its associated valve seat (118). This allows the fuel to "spill" across the valve seat (118) and hence causes the fuel pressure within the outlet passage (51) immediately above the needle (26) to fall to an intermediate pressure, below rail pressure but above back leak pressure. The resultant force imbalance on the nozzle needle (26) due to the difference between rail and intermediate pressures causes the nozzle needle (26) to rise thereby initiating an injection.

The needle to be described below is particularly suitable for use as the needle (26) in the common rail fuel injector of FIG. 1. It will be understood that the above described fuel injector is but one of many variations that are possible, and the needle described below is not limited to use in a fuel injector, let alone to use in a fuel injector having all of the features mentioned above.

Figure 2:
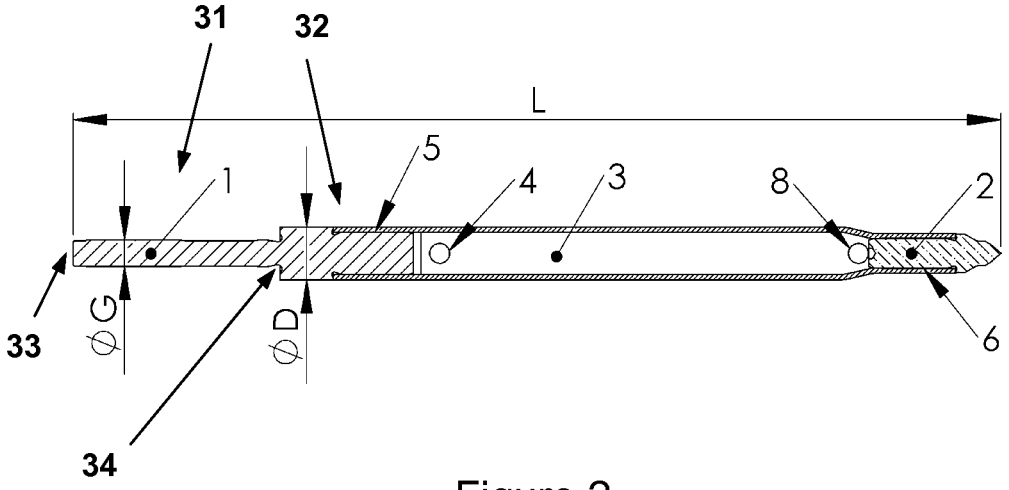
FIG. 2 shows a first embodiment of a needle for a needle valve.

A first embodiment of a needle for a needle valve is shown in FIG. 2. The needle has a tip section (2) comprising a needle tip, a first guide section (1) remote from the needle tip, and a second guide section in the form of a tube (3).

Figure 4:
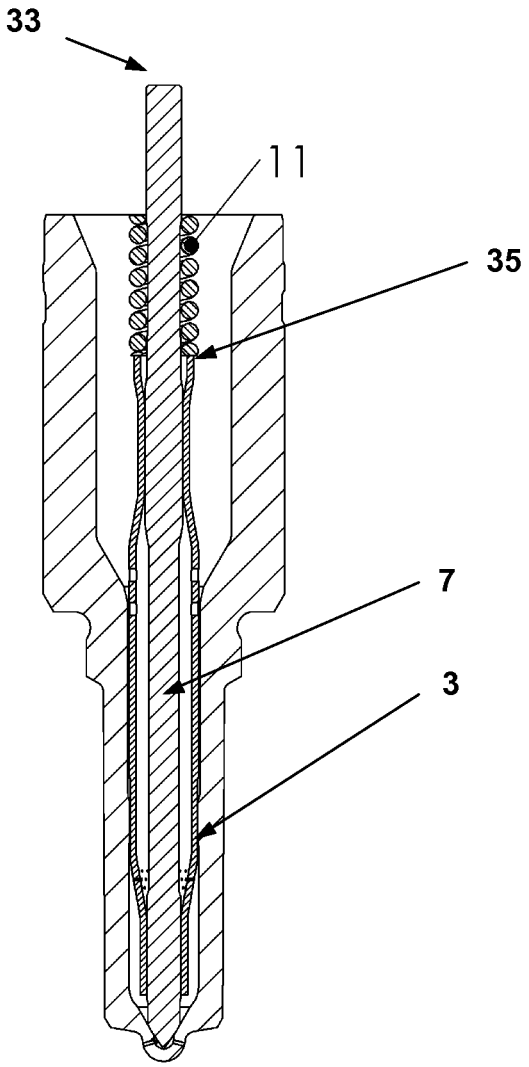
FIG. 4 shows the needle of FIG. 3B installed in a needle valve.

The needle has a first guide section in the form of an upper guide (1) that is adapted to be received in a bore of the valve body (such as bore (46) in the FIG. 1 arrangement). Pressure on the end surface (33) of the upper guide (1) drives the needle towards closure. In the arrangement shown, the upper guide (1) has a narrow guide section (31) and a main body section (32) of greater diameter. A step (34) is formed between the narrow guide section (31) and the main body section (32)—this step acts as a seat for a spring (not shown, though an equivalent arrangement is shown in FIG. 4) to bias the needle towards valve closure. For a needle valve for use in a fuel injector, a typical diameter G for the narrow guide section (31) could be 2 mm, and a typical diameter D for the main body section (32) could be 4 mm. In different designs of needle valve, G may be chosen to lie in the range of 1.5 mm to 5 mm, and D may be chosen to lie in the range 2 mm to 6 mm.

The tip section (2) is a discrete component, formed separately from the upper guide (1). While the upper guide (1) will typically be made of steel, the tip section (2) need not be—while it may be made from steel, it may also be made of a ceramic (such as silicon nitride, or zirconium oxide stabilized by magnesium oxide) where more suitable to the conditions experienced by the needle tip. The needle tip is adapted to form a sealing engagement against a valve body in the normal manner for a needle valve, for example as shown in the exemplary use in FIG. 1. In a needle for use in the needle valve of a fuel injector, a suitable overall length L for the needle may be 60 mm. In different designs of needle valve, L may be chosen to lie in the range 40 mm to 100 mm—in other designs, an even greater length of needle may be used.

The tip section (2) and the upper guide (1) are both retained within a tube (3), which forms a second guide section. At one end of the tube (3), the tube's inner surface forms a first interference fit (6) with an outer surface of the tip section (2). At the other end of the tube (3), the tube's inner surface forms a second interference fit (5) with the outer surface of the main body section (32) of the upper guide (1). In the region of the interference fit (5, 6), the tip section (2) and the upper guide (1) are recessed from the end up to a seat position, so that when the fit is made between the components, the tube (3) abuts with the seat formed on the tip section (2) and the upper guide (1). The size difference between the diameter of the tube and the larger diameter of the component to which the tube is fitted will typically be from 2 to 50 μm, depending on the operating parameters for the needle valve of which the needle is to be a part.

The tube (3) provides the only connection between the tip section (2) and the upper guide (1). The structural strength of the tube form means that if the tube (3) is made of a suitable material and at a suitable thickness, it will be sufficiently stiff and strong that the needle valve will function within its operating parameters, but it will also be very light. The tube (3) will typically be made of a suitable steel, and may have a wall thickness of approximately 0.5 mm—the wall thickness may in practice be chosen to provide an appropriate combination of rigidity and weight.

As the second guide is in the form of a hollow tube (3), it is possible for the fuel or other fluid dosed through the needle valve to flow through it. This may be desirable to prevent unnecessary pressures on the tube, and even (as discussed below) in some arrangements to protect the valve aperture area. In FIG. 2, the tube (3) is provided with a fuel inlet hole (4) near to the mounting on the upper guide (1) and with a fuel outlet hole (8) near to the mounting on the needle tip. These holes (4, 8) should be sufficiently large in size (for example 1.5 mm in diameter) if they are not intended to restrict the flow and create a pressure difference within the needle itself. In some embodiments, these holes may indeed be used to restrict flow and so affect the properties of a needle valve itself—in this case, the holes will be calibrated relative to the valve nozzle to achieve desired flow properties.

The components of the needle can be manufactured separately, and the needle assembled from the separate components. The upper guide (1) is a conventional machined part. The tip section (2) may similarly be a conventional machined part, or may be formed by any process appropriate to the material used to form it and the dimensions and tolerances required. The tube (3) requires at least one change in diameter between different parts of the tube. An effective way to do this and also to retain structural strength is to form the tube (3) by swaging (restricting the diameter of part of a tube by forcing it through an appropriately sized die). In the FIG. 2 arrangement, the tube (3) may be formed into its desired shape by swaging at the needle tip end. The holes (4, 8) in the tube (3) may be formed by conventional machining processes.

The tip section (2) and the upper guide (1) are then press fitted into the appropriate ends of the tube (3) to form the needle as shown in FIG. 2. The formation of recesses and seats in the interference fit regions of the tip section (2) and the upper guide (1) assists in ensuring that this press fitting achieves intended results in a replicable fashion.

Figure 3A:
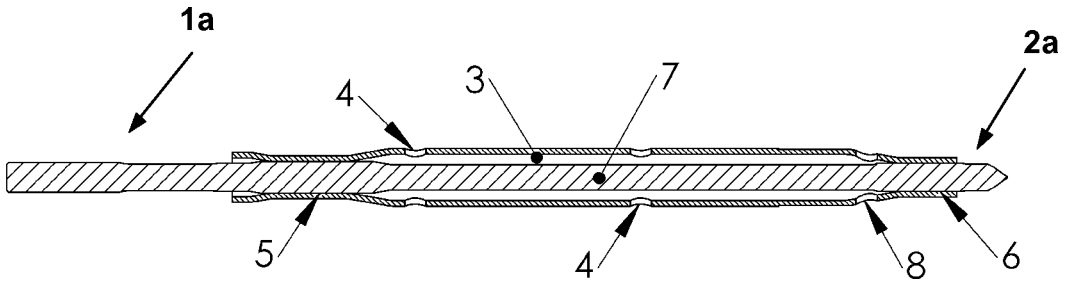
FIGS. 3A and 3B show second and third embodiments of a needle for a needle valve.
Figure 3B:
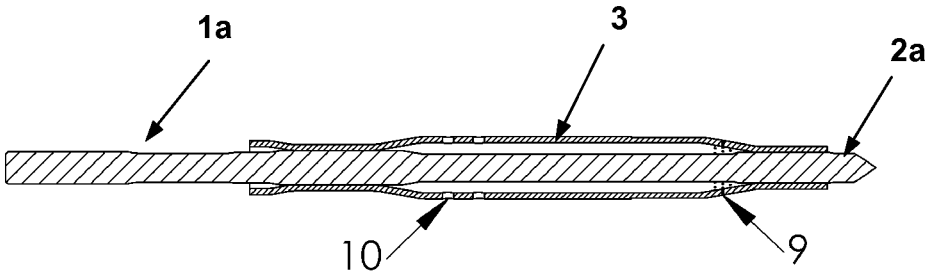

Needles according to second and third embodiments are shown in FIGS. 3A and 3B respectively. The needles of FIG. 3A and FIGS. 3B are examples of a variant to the FIG. 2 design—in this variant, the tip section (2*a*) and the upper guide section (1*a*) are not discrete components but are instead parts of an of an integrated inner needle component (7). This approach may provide greater axial strength and torsion resistance, as the axial load is shared between the inner needle component (7) and the tube (3). With this arrangement, the thickness of the inner needle component (7) can be reduced substantially beyond that of a conventional needle, as the rigidity of the needle is enhanced by the presence of the tube (3). The diameter of the inner needle component may be between 1 mm and 4 mm for needle valves of the type described above, depending on the axial load to be supported.

FIG. 3A shows a needle with a tube (3) adapted to form interference fits with both the needle tip section (2*a*) and the upper guide section (1*a*) of the inner needle component (7). Most of the axial load in this arrangement is taken by the inner needle component (7), with the tube (3) taking some axial load and increasing the overall rigidity of the arrangement. As the tube (3) takes significantly less axial load than in the FIG. 2 arrangement, less load needs to be supported by the two interference fits. In the arrangement shown in FIG. 3A, this allows the recess and seat arrangement used in FIG. 2 to be abandoned, with the interference fits not positively located on the inner needle component. If desired, a recess and seat arrangement of the type used in FIG. 2 could be used in the FIG. 3A arrangement (and similarly in the FIG. 3B arrangement) to define the interference length more clearly. Alternatives to a recess and seat arrangement could also be used for this purpose at one or both interference fits—diameter changes to the inner needle component (7) could be used, or grooves could be made in one of the components in the interference fit regions.

The third embodiment shown in FIG. 3B is another example of the design shown in FIG. 3A, but with different dimensions—the inner needle component 7 is shorter than for the second embodiment, and the needle is thus shorter overall. The length of the upper guide section (1*a*) and the needle tip section (2*a*) is constrained by their function, so in this case their length is unaffected and the length of tube (3) reduced along with the inner needle component (7).

The third embodiment uses differently sized holes (9, 10) in the tube to achieve different functional results. In this case small holes (0.025 mm to 0.15 mm in diameter) are used to allow flow inside the tube (3). These holes will restrict flow (and so a greater number of holes may be required to achieve desired flow properties), but will prevent debris from reaching the injection holes in the nozzle tip of the needle valve. These need not be circular holes—the holes may be shaped as desired to achieve particular fluid flow effects. For example, narrow slots (with widths as indicated above, but with greater length) may be used instead with the same function—these will allow more flow, while still having the same ability to block roughly spherical debris.

As the inner needle component (7) is a single component making an interference fit with the tube (3) at two different points, the second and third embodiments use a different construction of tube (3). At the upper guide end, the diameter of the tube (3) is reduced significantly by swaging—while the diameter of the inner needle component (7) is increased in the upper guide section (1*a*), it is still proportionally less than the diameter of the main body section of the upper guide in the first embodiment. This arrangement allows for easier creation of the interference fits, as discussed below.

The tube (3) is also modified in the second and third embodiments to provide another feature which simplifies the overall design. At the upper guide end of the tube (3), further away from the needle tip than the interference fit with the upper guide section (1*a*), the tube (3) is flared outwards to form a spring seat (35), replicating the function of the spring seat (34) in the first embodiment. This arrangement allows for simpler machining of the inner needle component (7) and prevents the creation of a recess that may act as a stress concentrator, and hence as a source of weakness in the needle as a whole.

Assembly of the needle of the second and third embodiments is slightly different from the assembly of the needle of the first embodiment. The inner needle component (7) may be manufactured using conventional machining processes and may be machined as a single component. The tube (3) may still be produced from conventional steel tube by swaging, but the swaging process at the upper guide end will be slightly more complex—a double swaging process may be used to produce the constriction and spring seat, or a single swaging process may be used with an appropriately designed bit or mandrel (or combination). The press fit of the inner needle component (7) into the tube (3) will be carried out by insertion of the needle tip section (2*a*) into the upper guide end of the tube (3). Sensors on the assembly used for this press fitting process may be used to determine load against displacement to ensure correct placement and tightness of the interference fits. In this arrangement, it is desirable for the second interference fit (5) to the upper guide section (1*a*) to be less tight than the first interference fit (6) to the needle tip section (2*a*). The diameter of the second interference fit (5) should also be greater than that of the first interference fit (6) to allow effective assembly. On assembly, the second interference fit will start to be made first, and the first interference fit made on further insertion of the inner needle component (7). This arrangement allows both interference fits to be checked for tightness on assembly.

In other embodiments, other connection methods (such as laser welding) may be used to provide connection between components rather than use of interference fits. This will generally complicate manufacture by adding additional steps, though it may be desirable where operating parameters required of a particular needle design cannot easily be met by use of interference fits.

FIG. 4 shows the needle of FIG. 3A fitted into a complete needle valve. As can be seen, the spring (11) rests on the spring seat formed by the end of the tube (3), and the needle tip section (2*a*) of the inner needle component (7) is seated on the nozzle section of the valve, such that when seated, fluid cannot pass through the nozzle apertures, but when there is sufficient hydraulic pressure in the gallery to lift the needle tip away from the seat, fluid is dosed through the needle apertures. The first and third embodiments will fit within a complete needle valve in essentially the same way—the use of the second embodiment here is simply an example of a complete needle valve using a needle according to embodiments as described here. The person skilled in the art will also readily see how the needle valve of FIG. 4 may be used in the fuel injector of FIG. 1. The use of such a needle, and such a needle valve, provides a number of practical advantages—lighter components, effective control of nozzle properties, and simple machining and construction. The person skilled in the art will also readily appreciate how changes may be made to the embodiments of FIGS. 2, 3A and 3B to provide further embodiments of the present invention.

The invention claimed is:

1. A needle for use in a needle valve, the needle comprising:

an integrated inner needle component comprising a tip section having a needle tip and a first guide section remote from the needle tip; and a tube forming a second guide section;

wherein the integrated inner needle component extends through the tube;

wherein the tube forming the second guide section is fixed to the tip section by a first interference fit;

wherein the tube forming the second guide section is fixed to the first guide section by a second interference fit;

and wherein the first interference fit is tighter than the second interference fit.

2. A needle as claimed in claim 1, wherein the tube is a metal tube.

3. A needle as claimed in claim 1, wherein an end of the tube associated with the first guide section is formed as a spring seat for a biasing spring of a needle valve.

4. A needle as claimed in claim 1, wherein the tube has a plurality of apertures between a first connection between the tube and the first guide section and a second connection between the tube and the tip section to allow fluid flow within the tube.

5. A needle as claimed in claim 4, wherein at least the apertures proximate to the connection with the tip section are holes or slots sized to prevent substantially spherical particles of 0.15 mm diameter or greater from passing therethrough.

6. A needle as claimed in claim 1, wherein one or both of the tip section and first guide section is recessed to form a seat for the tube forming the second guide section when each said recessed section is engaged with the second guide section.

7. In a fuel injector, a needle valve comprising a needle having:

an integrated inner needle component comprising a tip section having a needle tip and a first guide section remote from the needle tip; and a tube forming a second guide section;

wherein the integrated needle component extends through the tube;

wherein the tube forming the second guide section is fixed to the tip section by a first interference fit;

wherein the tube forming the second guide section is fixed to the first guide section by a second interference fit;

and wherein the first interference fit is tighter than the second interference fit.

8. A method of manufacturing a needle for a needle valve, comprising:

manufacturing an integrated component comprising a needle tip section and a first guide section for the needle;

manufacturing a tube to form a second guide section; and fixing the tube forming the second guide section both to the needle tip section and to the first guide section;

wherein fixing the second guide section to the needle tip section and the first guide section comprises press fitting the second guide section both on to the needle tip section to form a first interference fit and on to the first guide section to form a second interference fit such that the first interference fit is tighter than the second interference fit.

9. A method as claimed in claim 8, wherein the tube is a metal tube and manufacturing the tube comprises swaging the metal tube.

* * * * *